US005613642A

United States Patent [19]

Mulder et al.

[11] Patent Number: 5,613,642

[45] Date of Patent: Mar. 25, 1997

[54] PROCESS AND SYSTEM FOR WINDING AND TRANSPORTING A WOUND PACKAGE

[75] Inventors: Roger Mulder, Groningen; Willem Niewold, Wildervank; Peter J. C. Schimmel, Sappemeer, all of Netherlands; Jaap van der Woude, Pittsburgh, Pa.

[73] Assignee: PPG Industries, Inc., Pittsburgh, Pa.

[21] Appl. No.: 575,009

[22] Filed: Dec. 19, 1995

[51] Int. Cl.[6] ..... B65H 54/02; B65H 54/00

[52] U.S. Cl. ..... 242/35.5 A; 242/18 R; 242/42; 242/18 G

[58] Field of Search ..... 242/42, 35.5 A, 242/18 G, 18 DD, 18 R; 57/281

[56] References Cited

U.S. PATENT DOCUMENTS

| | | | |
|---|---|---|---|
| 338,631 | 3/1886 | Burnham . | |
| B 492,373 | 3/1976 | Patterson | 242/18 G X |
| 529,087 | 11/1894 | Stowe . | |
| 550,897 | 12/1895 | Rhoades . | |
| 623,404 | 4/1899 | Jones . | |
| 661,209 | 11/1900 | Duffy . | |
| 1,026,604 | 5/1912 | Rhoades . | |
| 1,248,247 | 11/1917 | Bentley . | |
| 2,131,470 | 9/1938 | Bowden | 242/35.5 |
| 2,405,215 | 8/1946 | Jacobson | 242/32 |
| 2,448,499 | 8/1948 | Swann . | |
| 2,811,319 | 10/1957 | Bakker | 242/35.5 |
| 3,048,349 | 8/1962 | Pitts et al. . | |
| 3,524,605 | 8/1970 | Cowan | 242/130 |
| 3,556,430 | 1/1971 | Eisenhammer | 242/129.51 |
| 3,672,583 | 6/1972 | Harrison | 242/18 R |
| 3,672,584 | 6/1972 | Macedo et al. | 242/18 R |
| 3,688,486 | 9/1972 | Bell et al. . | |
| 3,722,807 | 3/1973 | Swinehart | 242/18 R |
| 3,733,034 | 5/1973 | Allam et al. | 242/18 R |
| 3,797,775 | 3/1974 | White | 242/155 |
| 3,819,344 | 6/1974 | Thumm et al. | 242/18 G X |
| 3,830,440 | 8/1974 | Bense | 242/35.5 R |
| 3,831,873 | 8/1974 | Bense | 242/45 |
| 3,831,880 | 8/1974 | White et al. | 242/156 |
| 3,881,603 | 5/1975 | Stotler et al. | 214/1 D |
| 3,911,657 | 10/1975 | Bell et al. . | |
| 3,971,517 | 7/1976 | Matuura et al. | 242/18 R |
| 4,006,863 | 2/1977 | Bense | 242/18.1 |
| 4,009,839 | 3/1977 | Bense | 242/18 DD |
| 4,147,310 | 4/1979 | Harden et al. | 242/25 A |
| 4,390,647 | 6/1983 | Girgis . | |
| 4,413,981 | 11/1983 | White et al. | 474/94 |
| 4,540,029 | 9/1985 | Mihelich . | |
| 4,762,750 | 8/1988 | Girgis et al. | 428/378 |
| 4,762,751 | 8/1988 | Girgis et al. . | |
| 4,795,678 | 1/1989 | Girgis . | |
| 4,955,552 | 9/1990 | Menegatto | 242/35.5 |
| 5,082,193 | 1/1992 | Boni | 242/158 R |
| 5,222,350 | 6/1993 | Bowman et al. | 57/281 X |
| 5,289,675 | 3/1994 | Brockmanns et al. | 57/281 X |
| 5,302,175 | 4/1994 | Drummond . | |
| 5,359,843 | 11/1994 | Herold et al. | 57/281 X |
| 5,515,672 | 5/1996 | Koltze et al. | 57/281 |

FOREIGN PATENT DOCUMENTS

| | | |
|---|---|---|
| 0403927B1 | 9/1993 | European Pat. Off. . |
| 0424573B1 | 3/1995 | European Pat. Off. . |

OTHER PUBLICATIONS

Encyclopedia of Polymer Science and Technology, vol. 6 (1967) at pp. 505–712.

K. L. Loewenstein, "The Manufacturing Technology of Continuous Glass Fibres", (2d Ed. 1983), pp. 29, 33–45, 47–60, 118–120, 122–125, 169–177, 224–230, 243–295, 322, 317–323.

*Primary Examiner*—Michael R. Mansen

*Attorney, Agent, or Firm*—Ann Marie Odorski

[57] ABSTRACT

A system and process for winding and mechanically transporting a wound package includes: (a) a plurality of fibers; (b) a guide for gathering the fibers to form a bundle; (c) a winder having a rotatable package collector and an apparatus for rotating the package collector about a stationary generally vertical axis; and (d) a mechanical transport for receiving the wound package from the package collector and transporting the wound package from a first position to a second position horizontally spaced apart from the first position.

20 Claims, 4 Drawing Sheets

PROCESS AND SYSTEM FOR WINDING AND TRANSPORTING A WOUND PACKAGE

FIELD OF THE INVENTION

The present invention relates to a process and system for winding and transporting a package and, more particularly, for winding the package in a generally vertical orientation, releasing the package from the winder to a first position and mechanically transporting the package to a second position horizontally spaced apart from the first position.

BACKGROUND OF THE INVENTION

As raw material, labor and waste disposal costs escalate, technological advances provide a competitive means to increase productivity while decreasing cost. In labor intensive industries, advances in ergonomic or labor-saving technology can improve the work environment, as well as provide increased productivity and efficiency.

In the fiber glass industry, forming and roving operations, in which glass filaments and fiber strands, respectively, are wound into packages, are examples of labor intensive operations in which technological advances are needed. In the forming area, glass filaments are drawn at a high rate of speed from a fiber forming apparatus, or bushing, connected to a supply of molten glass. The filaments are gathered into one or more fibers and wound upon a rotating collet of a winder to create a forming package. During winding, a conventional collet rotates about a horizontal, longitudinal axis. Similarly, roving packages are formed by gathering a plurality of strands and winding the strands about a collet rotating about a horizontal, longitudinal axis.

Typical forming and roving packages weigh about 10 to about 250 kilograms and have diameters of about 0.18 meters to about 0.75 meters, making manual removal of the packages from the horizontal collet an unwieldy, inefficient and labor intensive process. Manual capabilities limit the practical package size when a horizontal collet is used.

It is desirable to increase package size to increase productivity and decrease waste, since the inner and outer layers of a package and product produced between winding packages (downchute waste) are typically discarded. A system is needed which facilitates winding of larger wound packages and manipulation and transportation of any size of wound package to reduce labor and waste disposal costs and increase efficiency and productivity.

SUMMARY OF THE INVENTION

The present invention provides a system for winding and mechanically transporting a wound package, the system comprising: (a) a plurality of fibers; (b) a guide for gathering the plurality of fibers to form a bundle; (c) a winder comprising a rotatable package collector and an apparatus for rotating the package collector about a stationary generally vertical axis, the package collector receiving the bundle from the guide and forming the bundle into a wound package about the generally vertical axis, the package collector having a release for releasing the wound package so as to deposit the wound package on a mechanical transport; and (d) a mechanical transport for receiving the wound package from the package collector and transporting the wound package from a first position to a second position horizontally spaced apart from the first position.

Also provided by the present invention is a process for winding a bundle of fibers to form a wound package at a first position and mechanically transporting the wound package to a second position horizontally spaced apart from the first position, the process comprising: (a) supplying a plurality of fibers; (b) gathering the plurality of fibers to form a bundle; (c) winding the bundle upon a rotatable package collector of a winder about a stationary generally vertical axis to form a wound package; (d) releasing the wound package from the package collector to a first position; and (e) mechanically transporting the wound package released from the package collector from the first position to a second position horizontally spaced apart from the first position.

BRIEF DESCRIPTION OF THE DRAWINGS

The foregoing summary, as well as the following detailed description of the preferred embodiments, will be better understood when read in conjunction with the appended drawings. In the drawings.

DETAILED DESCRIPTION OF THE INVENTION

The process and system of the present invention represent an economical, ergonomically desirable technological advance which provides increased productivity and efficiency by facilitating winding of multiple fibers into packages and transportation of the same.

Figure 1:
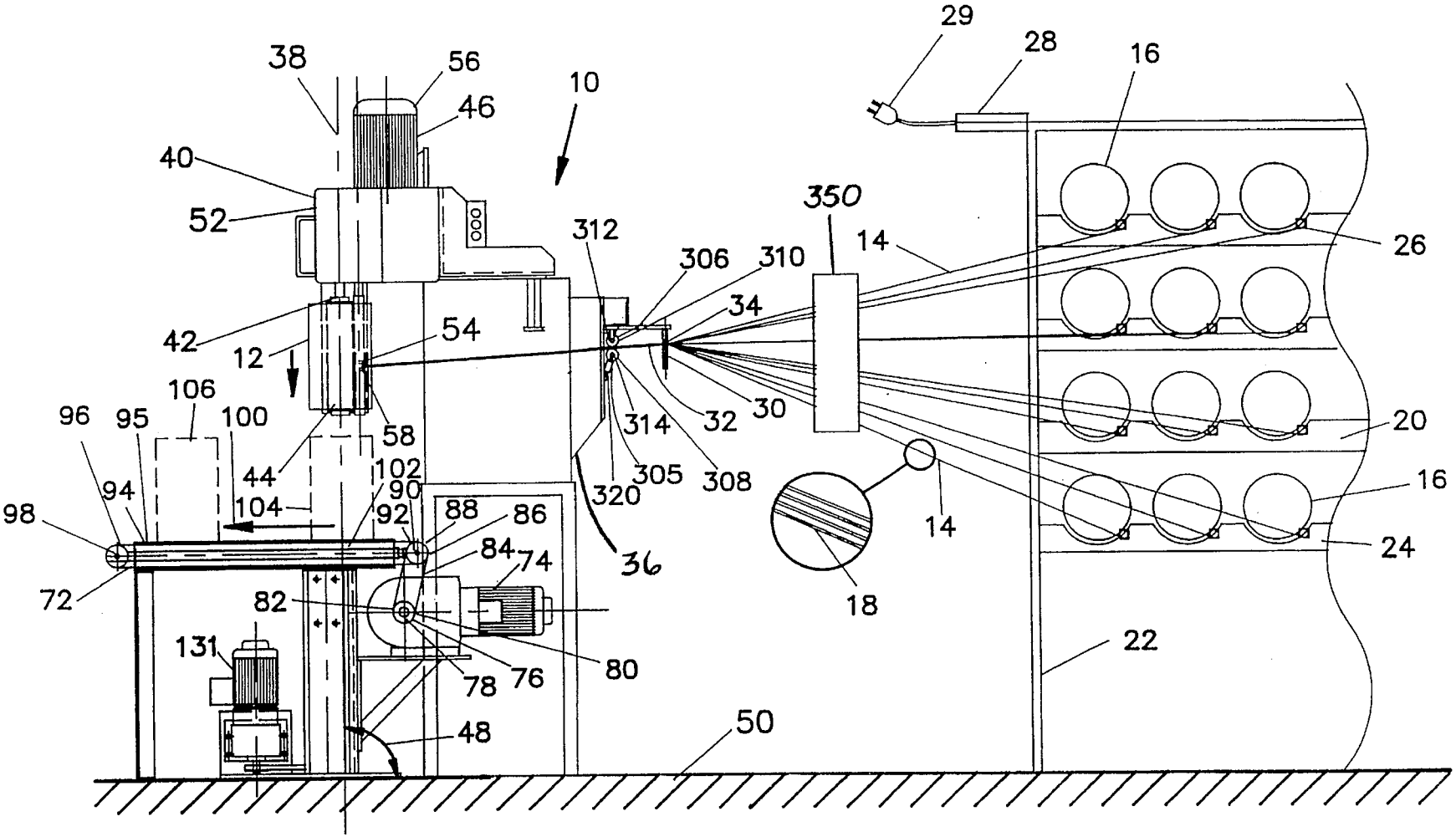
FIG. 1 is a schematic side elevational view of a preferred system for winding and mechanically transporting a wound package, in accordance with the present invention.
Figure 2:
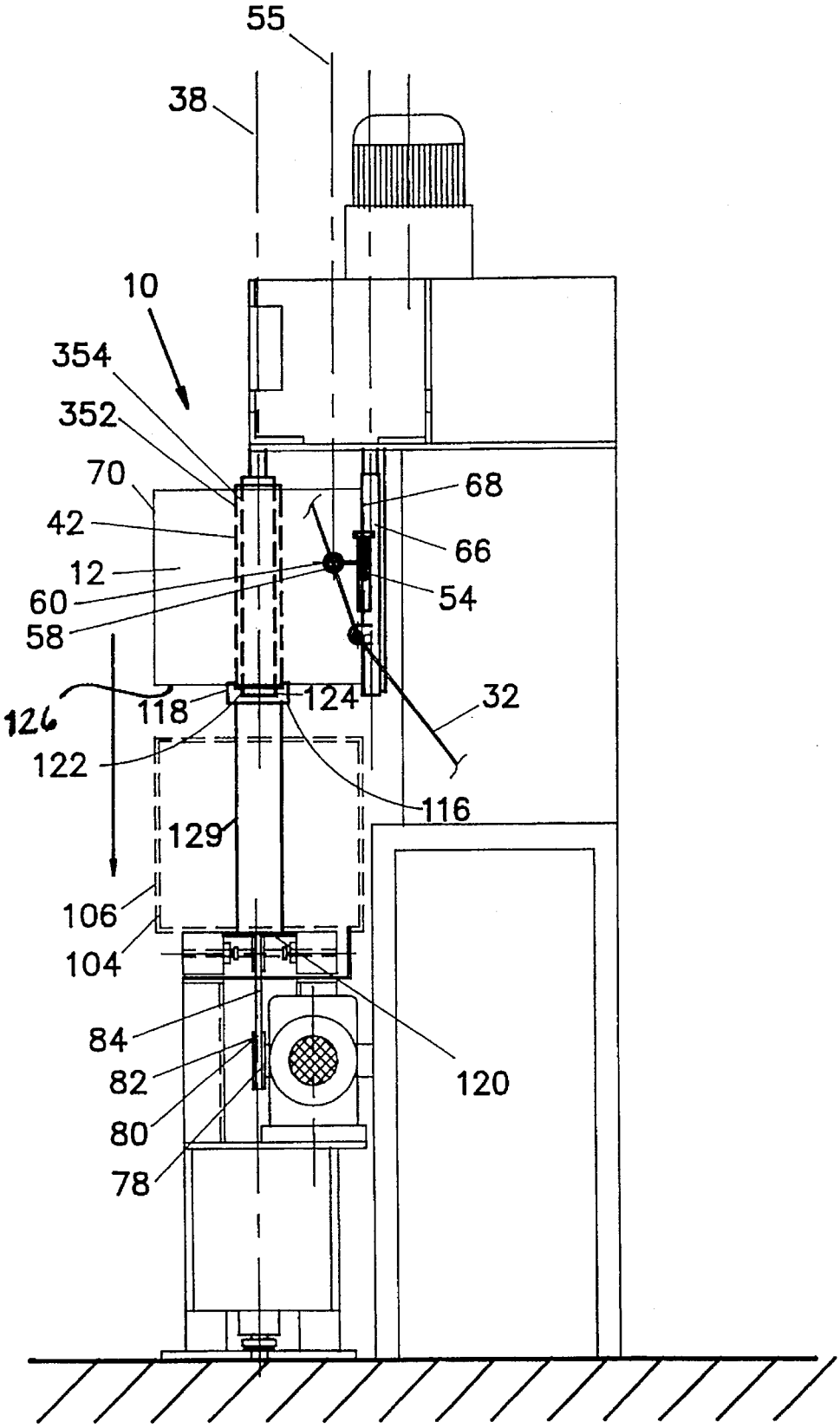
FIG. 2 is a schematic front elevational view of a portion of the system of FIG. 1 showing the winder.
Figure 3:
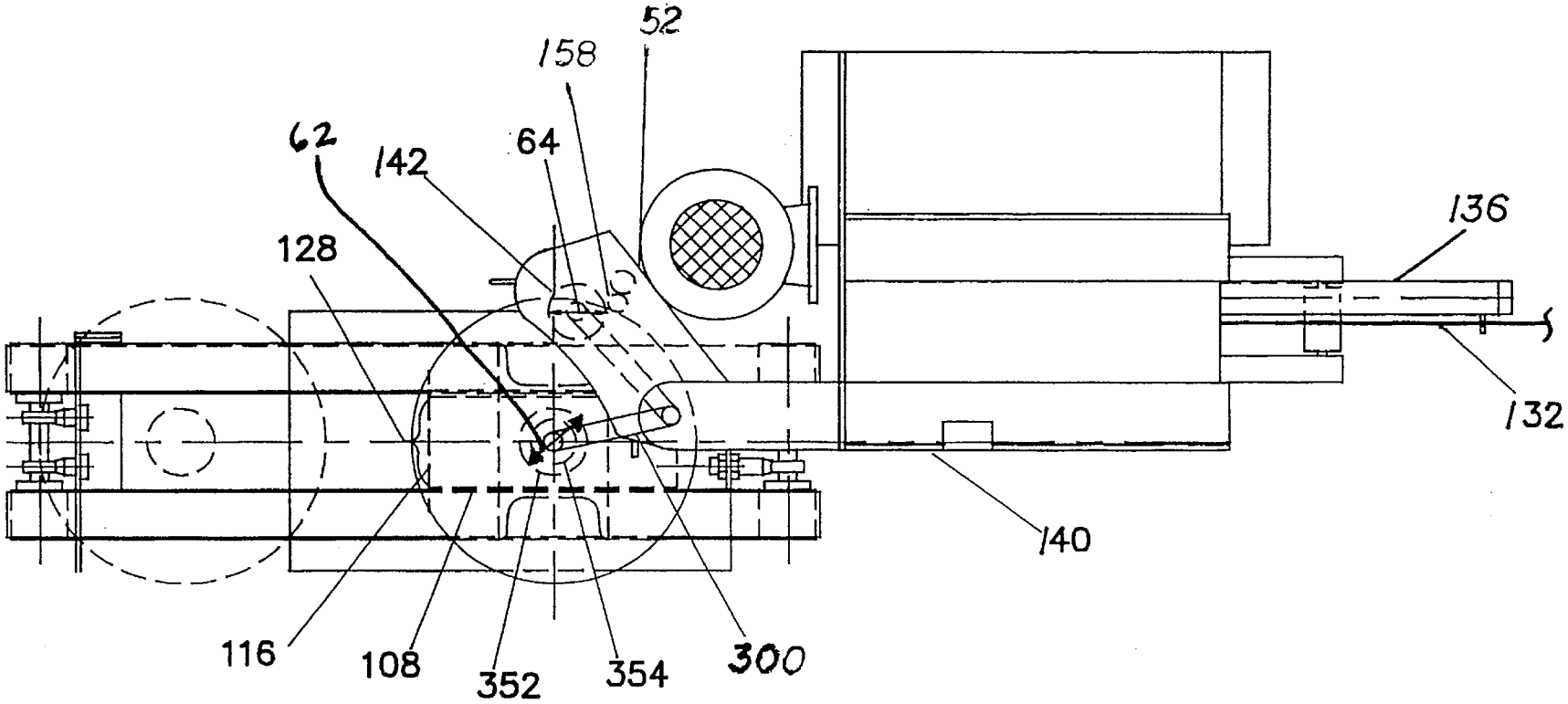
FIG. 3 is a schematic top plan view of a portion of the system of FIG. 1 showing the winder.

Referring to the drawings, wherein like numerals indicate like elements throughout, there is shown in FIGS. 1–3 a preferred embodiment of a system, generally designated 10, for winding and mechanically transporting a wound package 12, in accordance with the present invention.

The system includes a plurality of fibers 14 from which the wound package 12 is formed. As used herein, the term "fibers" means a plurality of individual filaments or a plurality of strands. The term "strand" as used herein refers to a plurality of individual filaments.

The present invention is generally useful in the winding of fibers, strands, yarns or the like of natural or man-made materials. Fibers believed to be useful in the present invention are discussed at length in the *Encyclopedia of Polymer Science and Technology,* Vol. 6 (1967) at pages 505–712, which is hereby incorporated by reference.

Suitable natural materials include those derived directly from animal, vegetable and mineral sources. *Encyclopedia of Polymer Science and Technology,* Vol. 6 at 505–506; 522–542; 691–712. Examples of methods for preparing and processing such natural fibers are also discussed in the *Encyclopedia of Polymer Science and Technology,* Vol. 6 at 709–712. Further discussion thereof is not believed to be necessary in view of the above and the present disclosure. Non-limiting examples of animal and vegetable-derived natural materials include cotton, cellulose, natural rubber, flax, ramie, hemp, sisal and wool. Examples of suitable minerals include mineral wool and basalt.

Suitable man-made fibers can be formed from a fibrous or fiberizable material prepared from natural organic polymers, synthetic organic polymers or inorganic substances. *Encyclopedia of Polymer Science and Technology,* Vol. 6 at 506–507. As used herein, the term "fiberizable" means a material capable of being formed into a generally continuous filament, fiber, strand or yarn.

Man-made fibers produced from natural organic polymers are regenerated or derivative. *Encyclopedia of Polymer Science and Technology,* Vol. 6 at 506. A regenerated fiber is formed when a natural polymer or its chemical derivative is dissolved and extruded as a continuous filament which retains, or after fiber forming has regenerated, the chemical nature of the natural polymer. *Encyclopedia of Polymer Science and Technology,* Vol. 6 at 506. An example of a regenerated fiber is a regenerated cellulosic fiber. *Encyclopedia of Polymer Science and Technology,* Vol. 6 at 542–548. A derivative fiber is formed when a chemical derivative of the natural fiber is prepared, dissolved and extruded as a continuous filament which retains the chemical nature of the derivative. *Encyclopedia of Polymer Science and Technology,* Vol. 6 at 506.

Man-made fibers can also be based upon synthetic polymers such as polyamides, polyesters, acrylics, polyolefins, polyurethanes, vinyl polymers, derivatives and mixtures thereof. *Encyclopedia of Polymer Science and Technology,* Vol. 6 at 506.

Suitable man-made fibers can be formed by a variety of polymer extrusion and fiber formation methods, such as for example drawing, melt spinning, dry spinning, wet spinning and gap spinning. Such methods are well known to those skilled in the art and further discussion thereof is not believed to be necessary in view of the present disclosure. If additional information is needed, such methods are disclosed in *Encyclopedia of Polymer Science and Technology,* Vol. 6 at 507–508.

Non-limiting examples of useful polyamide fibers include nylon fibers such as nylon 6 (a polymer of caprolactam), nylon 6,6 (a condensation product of adipic acid and hexamethylenediamine), nylon 12 (which can be made from butadiene) and nylon 10. Many of these nylons are commercially available from E. I. dupont de Nemours and Company of Wilmington, Del. and BASF Corp. of Parsippany, N.J. Other useful polyamides include polyhexamethylene adipamide, polyamide-imides and aramids such as KEVLAR™, which is commercially available from dupont.

Thermoplastic polyester fibers useful in the present invention include those composed of at least 85% by weight of an ester of a dihydric alcohol and terephthalic acid, such as polyethylene terephthalate (for example DACRON™ which is commercially available from dupont and FORTREL™ which is commercially available from Hoechst Celanese Corp. of Summit, N.J.) and polybutylene terephthalate.

Fibers formed from acrylic polymers believed to be useful in the present invention include polyacrylonitriles having at least about 35% by weight acrylonitrile units, and preferably at least about 85% by weight, which can be copolymerized with other vinyl monomers such as vinyl acetate, vinyl chloride, styrene, vinylpyridine, acrylic esters or acrylamide. See *Encyclopedia of Polymer Science and Technology,* Vol. 6 at 559–561. A non-limiting example of a suitable acrylic polymer fiber is ORLON™, a copolymer which contains at least 85% acrylonitrile which is commercially available from dupont.

Useful polyolefin fibers are generally composed of at least 85% by weight of ethylene, propylene, or other olefins. See *Encyclopedia of Polymer Science and Technology,* Vol. 6 at 561–564.

Fibers formed from vinyl polymers believed to be useful in the present invention can be formed from polyvinyl chloride, polyvinylidene chloride (such as SARAN™, which is commercially available from Dow Plastics of Midland, Mich.), polytetrafluoroethylene, and polyvinyl alcohol (such as VINYLON™, a polyvinyl alcohol fiber which has been crosslinked with formaldehyde).

Further examples of thermoplastic fiberizable materials believed to be useful in the present invention are fiberizable polyimides, polyether sulfones, polyphenyl sulfones; polyetherketones, polyphenylene oxides, polyphenylene sulfides and polyacetals.

Suitable elastomeric fibers are synthetic rubbers or spandex polyurethanes in which the fiber-forming substance is a long-chain synthetic polymer comprised of at least 85% by weight of a segmented polyurethane having alternating soft and hard regions in the polymer structure. See *Encyclopedia of Polymer Science and Technology,* Vol. 6 at 564–566 and 573–591. As used herein, the term "elastomeric fiber" means a fiber that will recover from long-range deformations immediately upon removal of the deforming force. *Encyclopedia of Polymer Science and Technology,* Vol. 6 at 564. A commercial spandex fiber is LYCRA™, which is available from dupont.

It is understood that blends or copolymers of any of the above materials and combinations of fibers formed from any of the above materials can be used in the present invention, if desired.

Suitable inorganic fibers are discussed in the *Encyclopedia of Polymer Science and Technology,* Vol. 6 at 610–690 and include glass and polycrystalline fibers, such as ceramics including silicon carbide, and carbon or graphite.

The preferred fibers for use in the present invention are glass fibers, a class of fibers generally accepted to be based upon oxide compositions such as silicates selectively modified with other oxide and non-oxide compositions. Useful glass fibers can be formed from any type of fiberizable glass composition known to those skilled in the art, and include those prepared from fiberizable glass compositions such as "E-glass", "A-glass", "C-glass", "D-glass", "R-glass", "S-glass", and E-glass derivatives that are fluorine-free and/or boron-free. Such compositions and methods of making glass filaments therefrom are well known to those skilled in the art and further discussion thereof is not believed to be necessary in view of the present disclosure. If additional information is needed, such glass compositions and fiberization methods are disclosed in K. Loewenstein, "The Manufacturing Technology of Glass Fibers", (2d Ed. 1983) at pages 29, 33–45, 47–60, 118–120 and 122–125, which is hereby incorporated by reference.

Preferably, the fibers are essentially free of metallic fibers, such as aluminum, steel and copper. See *Encyclopedia of Polymer Science and Technology,* Vol. 6 at 569–570.

Combinations of fibers formed from any of the above organic and inorganic materials can be used in the present invention.

Preferably, one or more coating compositions are present on at least a portion of the surfaces of the glass fibers to protect the surfaces from abrasion during processing. Non-limiting examples of suitable coating compositions include sizing compositions and secondary coating compositions. As used herein, the terms "size", "sized" or "sizing" refer to the aqueous composition applied to the filaments immediately after formation of the glass fibers. The term "secondary coating" refers to a coating composition applied secondarily to one or a plurality of strands after the sizing composition is applied, and preferably at least partially dried.

Typical sizing compositions can include as components film-formers, lubricants, coupling agents, emulsifiers, antioxidants, ultraviolet light stabilizers, colorants, antistatic agents and water, to name a few. Examples of suitable sizing compositions are set forth in K. Loewenstein at pages 243–295 (2d Ed. 1983) and U.S. Pat. Nos. 4,390,647 and 4,795,678, each of which is hereby incorporated by reference.

The sizing can be applied in many ways, for example by contacting the filaments with a static or dynamic applicator, such as a roller or belt applicator, spraying or other means. See Loewenstein at pages 169–177, which is hereby incorporated by reference.

The sized fibers are preferably dried at room temperature or at elevated temperatures. Drying of glass fiber forming packages or cakes is discussed in detail in Loewenstein at pages 224–230, which is hereby incorporated by reference. For example, the forming package can be dried in an oven at a temperature of about 104° C. (220° F.) to about 160° C. (320° F.) for about 10 to about 24 hours to produce glass fiber strands having a dried residue of the composition thereon. The temperature and time for drying the glass fibers will depend upon such variables as the percentage of solids in the sizing composition, components of the sizing composition and type of glass fiber. The sizing is typically present on the fibers in an amount between about 0.1 percent and about 5 percent by weight after drying.

Figure 4:
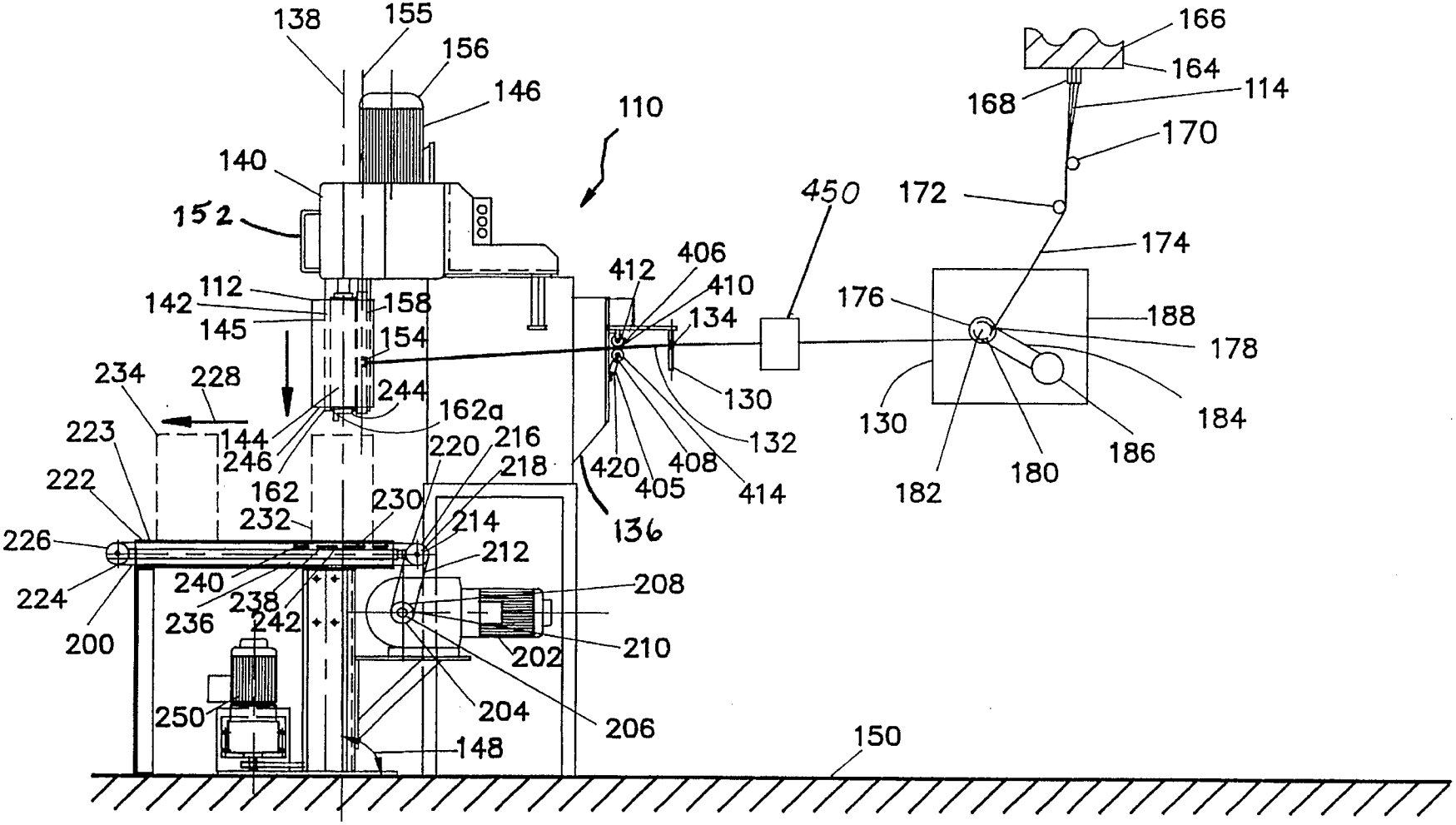
FIG. 4 is a schematic side elevational view of an alternative embodiment of a system for winding and mechanically transporting a wound package, in accordance with the present invention.

Suitable ovens for drying glass fibers are well known to those skilled in the art. Referring to FIGS. 1 and 4, in a preferred drying method, the fibers 14, 114 are passed through a dryer 350,450 which contains hot air at a temperature of about 100° C. to about 200° C. The dryer removes excess moisture from the fibers 14, 114 and, if present, cures any curable sizing or secondary coating composition components. The fibers 14, 114 can be threaded about a pair of roller bars positioned proximate the inlet and the outlet of the dryer such that the fibers 14, 114 make multiple passes through the dryer. Alternatively, an infrared dryer can be used.

After drying, the sized glass strands can be gathered together into bundles of generally parallel fibers or roving and can be further treated with a secondary coating composition which is different from the sizing composition. As used herein, the term "bundle" refers to a plurality of fibers. The secondary coating composition can include one or more of the components of the sizing composition discussed above, and is preferably aqueous-based. Non-limiting examples of suitable secondary coating compositions are disclosed in U.S. Pat. Nos. 4,762,750 and 4,762,751, which are hereby incorporated by reference.

The secondary coating composition is applied to at least a portion of the surface of the strands in an amount effective to coat or impregnate the portion of the strands. The secondary coating composition can be conventionally applied by dipping the strand in a bath containing the composition, by spraying the composition upon the strand or by contacting the strand with a static or dynamic applicator such as a roller or belt applicator, for example. The coated strand can be passed through a die to remove excess coating composition from the strand and/or dried as discussed above for a time sufficient to at least partially dry or cure the secondary coating composition.

The present invention will now be discussed generally in the context of its use in the winding and transportation of glass fibers. However, one of ordinary skill in the art would understand that the present invention is useful in the processing of any of the fibers discussed above.

Referring now to FIGS. 1–3, in the preferred system 10 the fibers 14 are supplied by a plurality of fiber supply packages 16 or forming packages. Twelve supply packages 16 are shown in FIG. 1. One skilled in the art would understand that the number of supply packages 16 can be one or more, as desired, as long as a plurality of fibers 14 is supplied to the system 10. The preferred number of supply packages 16 is about 1 to about 80, and more preferably about 1 to about 60.

As shown in FIG. 1, each supply package 16 has at least one fiber 14 or strand wound thereon. In the preferred system, each fiber 14 comprises a plurality of generally linear filaments 18, for example continuous glass filaments. Each supply package 16 is typically cylindrically-shaped and has a hollow center. The supply package can be wound such that the fiber 14 can be withdrawn from the inside of the supply package 16 or preferably from the outside of the supply package 16 (known in the art as "filling wind"). The dimensions of the supply package 16 can vary, depending upon such variables as the diameter and type of fiber wound thereon, and are generally determined by convenience for later handling and processing. Generally, supply packages 16 are about 15.2 to about 76.2 centimeters (about 6 to about 30 inches) in diameter and have a length of about 5.1 to about 101.6 centimeters (about 2 to about 40 inches). Further examples of conventional supply or forming package 16 dimensions are set forth in U.S. Pat. Nos. 3,685,764 and 3,998,326, each of which is hereby incorporated by reference. The sides of the supply package 16 can be tapered or rounded.

Referring to FIG. 1, each supply package 16 is held by a support member 20 of a frame 22 of a creel 24. Conventional creels suitable for use in the present system 10 are shown in K. Loewenstein, *The Manufacturing Technology of Continuous Glass Fibers* (2d Ed. 1983) at page 322, which is hereby incorporated by reference.

The system 10 of the present invention can further include a plurality of tensioning devices 26. Each tensioning device 26 can be positioned upon the creel 24 adjacent a respective supply package 16 or can be as simple as a weight suspended from the fiber 14 drawn from the supply package 16. Each tensioning device 26 receives a fiber 14 withdrawn from its respective supply package 16 and applies a tension to that fiber 14.

It is preferred that at least one of the tensioning devices 26 comprises a magnetic hysteresis brake or magnetic particle brake. The preferred tensioning devices 26 are ACCUTENSE® Model 250 electromagnetic hysteresis brakes or strand tension heads, which are commercially available from Textrol, Inc. of Monroe, N.C.

The tension or braking force applied by each tensioning device 26 to its respective fiber 14 as it is withdrawn from the supply package 16 by the winder 40 can be controllably varied, for example, by changing the flux density of the controlling electromagnetic field, as disclosed in U.S. Pat. No. 3,797,775, which is hereby incorporated by reference.

For example, the tension applied to the fiber 14 can be varied by varying direct current (DC) voltage input to the tensioning device 26. Referring now to FIG. 1, each of the tensioning devices 26 is connected to a tensioning device controller 28 which regulates the power supply 29 and thereby the tension being applied to each fiber 14 by each tensioning device 26, such that substantially the same tension is applied to each fiber 14. Preferably, the tensioning device controller 28 includes means to sense breakage or entangling of a fiber 14 and signal an operator (not shown), winder 40 or other components of the system 10 to stop the winding operation.

The preferred controller 28 is a conventional two-step controller, such as the AccuPower variable voltage regulated power supplier which is commercially available from Textrol, Inc. Similar tensioning devices and controllers are disclosed in U.S. Pat. Nos. 3,797,775, 3,831,880 and 4,413,981, each of which is hereby incorporated by reference.

The tension applied to each fiber 14 is preferably about 60 to about 120 grams and, more preferably, about 90 grams with a tension variation of less than about 10 grams. Preferably, the overall variation in tension between each of the fibers 14 is less than about 20 grams. The ACCUTENSE® Model 250 has a tension range of about 5 to 250 grams (0 to 60 volts DC). The desired tension can differ based upon such variables as the type of fiber material, fiber diameter, coating on the fiber, etc.

In the alternative embodiment shown in FIG. 4, the fibers 114 are supplied from a fiber forming apparatus 164. The fiber forming apparatus 164 preferably comprises a glass melting furnace or forehearth 166 containing a supply of a fiber forming mass or molten glass (not shown) having a precious metal bushing 168 attached to the bottom of the forehearth 166. Alternatively, the fiber forming apparatus 164 can be, for example, a forming device or spinneret for synthetic textile fibers or strands.

As shown in FIG. 4, the bushing 168 is provided with a series of orifices in the form of tips through which molten glass is drawn in the form of individual fibers 114 or filaments at a high rate of speed. The glass fibers 114 can be cooled by spraying with water (not shown) and then coated with a sizing composition by an applicator device 170 which contacts the fibers 114 prior to entering the alignment device. The preferred sizing applicator is a graphite roll applicator as shown in FIG. 4. Other examples of suitable sizing composition applicators are discussed above.

The glass fibers 114 are gathered by an alignment device which aligns each of the fibers 114 such that each of the fibers 114 is generally adjacent and coplanar to each other. As used herein when referring to the alignment of the fibers 114, the term "adjacent" means that the fibers 114 are spaced apart or contacting in side-by-side or generally parallel alignment such that the fibers 114 will generally be free of overlap when wound in a layer about the rotatable collector.

The alignment device is generally spaced apart from the fiber forming apparatus 164 to receive the plurality of fibers 114 from the fiber forming apparatus 164 positioned above the alignment device. However, the alignment device can receive the plurality of fibers from the supply source at any angle desired. The alignment device preferably aligns the fibers 114 generally perpendicularly to a longitudinal axis of the fiber forming apparatus 164.

The alignment device can be any device(s) known to those skilled in the art for aligning or gathering fibers such that each of the fibers is generally parallel and coplanar. Non-limiting examples of suitable alignment devices include rotatable or stationary gathering shoes or a comb, as discussed in Loewenstein at pages 178–179, which are hereby incorporated by reference. The alignment device can be fabricated from any generally rigid natural or synthetic material, such as graphite, cotton and phenolic resin laminate, micarta or other reinforced phenolic laminates.

As shown in FIG. 4, the preferred alignment device for the alternative embodiment comprises a plurality of graphite split stationary gathering shoes 172 which gather a plurality of fibers 114 to form a plurality of strands 174 and align the strands 174 in a generally adjacent and coplanar arrangement.

While FIG. 4 shows three strands 174 being drawn from the forehearth 166, it is understood by those skilled in the art that the plurality of strands 174 can comprise two or more strands, as desired. Preferably, the plurality of strands 174 comprises 2 to 20 strands and, more preferably, 2 to 16 strands. Also, strands 174 can be drawn from a plurality of adjacent bushings.

Referring now to FIGS. 1–4, the system 10, 110 comprises one or more guides 30, 130 for gathering the plurality of fibers 14, 114 into a bundle 32, 132. The guide 30, 130 can be spaced apart from the frame 22 or fiber forming apparatus 164 to minimize the converging angles of the fibers 14, 114 to be gathered into the bundle 32, 132 and to prevent broken fibers 14, 114 from being entrained into the wound package 12, 112.

Referring now to the preferred embodiment of FIGS. 1–3, the preferred guide 30 has a guide eye 34 or aperture through which the fibers 14 are threaded and gathered into a bundle 32. Each guide eye 34 is preferably circular to reduce strand abrasion and can have a diameter of about 3 millimeters to about 25 millimeters, although the guide eye 34 can be of any shape or size desired.

The guide 30 is mounted upon a support frame 36. The support frame 36 can be formed from a rigid material such as stainless steel, carbon steel or aluminum. The guide 30 is aligned such that the bundle 32 which passes therethrough is oriented generally perpendicularly to a stationary generally vertical longitudinal axis 38 of the wound package 12 and package collector. It is preferred that the guide eye 34 be positioned as far from the winder 40 as possible to prevent separation of the individual fibers 14 prior to winding.

In the alternative embodiment shown in FIG. 4, the guide 130 includes both a pulley 176 and a guide eye 134 similar to that discussed above. The pulley 176 reorients the direction of travel of the strands 174 from a generally vertical direction after drawing from the fiber forming apparatus 164 to a generally horizontal direction to align the strands 174 for vertical winding.

The pulley 176 comprises a rotatable pulley roll 178 having a groove 180 for gathering the strands 174 to form the bundle 132. The pulley roll 178 can, for example, be mounted for rotational movement about a shaft 182 connected to a pivotable member 184. The pivotable member 184 pivots about a pivot 186 which is connected to a stationary frame 188. The tension imparted to the bundle 132 by the pulley roll 178 can be varied by using a driven pulley roll, a pulley roll having a different diameter, groove coating or groove angle or by applying a biasing force to the pivotable member 184, for example by using a spring or piston and cylinder (not shown).

Referring to FIGS. 1–4, the support frame 36, 136 can further include a bundle tensioning device 305,405. The preferred bundle tensioning device comprises a feed roll 306,406 and a cooperating nip roll 308,408 for applying pressure to the fibers 14 or strands 174 in a direction generally perpendicular to an outer surface 310, 410 of the driven feed roll 306,406. The bundle tensioning device applies pressure to the fiber bundle 32, 132 without significant wrapping of the strands 174 around the feed rolls 306,406 or nip rolls 308,408.

Both the feed roll 306,406 and the nip roll 308,408 are mounted upon the support frame 36, 136 which permits free rotation of the rolls 306,406 and 308,408 in a direction generally parallel to the direction of advancement of the fibers 14 or strands 174. The bundle tensioning device 305,405 is preferably positioned to minimize the angle between incoming fibers 14 or strands 174 and the region of contact between the feed and nip rolls 306,406 and 308,408. The axis 312, 412 of rotation of the feed roll 306,406 and the axis 314, 414 of rotation of the nip roll 308,408 are generally parallel and coplanar.

The feed roll 306,406 can be driven, but preferably is freely rotatable. If driven, the feed roll 306,406 speed can be varied by the feed drive device in response to, for example, changes in the winder speed as the diameter of the package 12, 112 increases. The feed roll 306,406 can driven by a feed drive device and conventional motor through a drive shaft. The feed drive device can be a regenerative direct current (DC) drive (such as SECO® Quadraline 7000 DC drives, which are commercially available from Warner Control Techniques of Lancaster, S.C.) or an alternating current (AC) drive with dynamic braking which is capable of correcting both positive and negative deviations from a speed setpoint. The feed drive device, therefore, acts as a generator and provides braking torque. Alternatively, the drive shaft of the feed roll 306,406 can be driven by a variable speed DC motor. The motor speed can be controlled by a feed device controller. The feed device controller can be a conventional programmable logic controller which is capable of activating and deactivating the feed drive device and motor of the bundle tensioning device 305,405, such as a an analog programmable logic controller The outer surface 310, 410 of the feed roll 306,406 provides non-slipping frictional drive when the bundle is under compression from nip roll 308,408. For example, the outer surface 310,410 of the feed roll 306,406, as well as the outer surface of the nip roll 308,408, can be coated with a non-abrasive, friction material such as a urethane compound to provide these attributes.

The outer surface of the nip roll 308,408 is biased to contact the outer surface of the feed roll 306,406 and thereby apply pressure to a portion of the bundle passing therebetween to prevent the strands from slipping.

The nip roll 308,408 is attached to a nip roll pressurizing device, is preferably a piston and cylinder arrangement 320,420, mounted to the bundle tensioning device 305,405. The movement of the piston is regulated by changes in the fluid, such as air or oil, in the cylinder. Preferably, each of the ends of the shaft of the nip roll 308,408 are attached to a yoke connected to a single piston and cylinder arrangement 320,420 or pneumatic air cylinder having a 2.50 inch bore and 1.00 inch stroke, such as is commercially available from Bimba of Monel, Ill. as Model No. 501-DXP. Alternatively, each of the ends of the shaft of the nip roll 308,408 can be attached to two piston and cylinder arrangements.

Generally, the pressure applied by the nip roll 308,408 to the bundle is about 681.8 to about 1136.4 grams (about 1.5 to about 2.5 lb.), and preferably about 1000 grams (about 2.2 lb.). The pressure applied by the nip roll 308,408 can vary based upon such variables as the strand diameter, strand coating and the number of strands in the bundle, to name a few.

Alternatively, the bundle tensioning device can be a plurality of generally parallel cylindrical tensioning rolls. The rolls can be aligned to regulate the desired tension to the bundle. The alignment of the rolls can be determined by measuring the bundle tension after exiting the rolls or by measuring the weight of the wound package. The diameter of each roll can be about 1 to about 5 centimeters, and preferably about 1 to about 3 centimeters. Preferably, the rolls have equal diameters, although the rolls can have different diameters, if desired. The surface of each roll is preferably coated with non-abrasive material, such as polished aluminum oxide or titanium dioxide, to reduce abrasive wear of the fibers of the bundle. In another alternative embodiment, the bundle tensioning device can be the alignment device.

Referring to FIGS. 1–4, the system 10, 110 also comprises a winder 40, 140 for receiving the bundle 32, 132 from the guide 30, 130, advancing and applying a tension to the bundle 32, 132, and forming the bundle 32, 132 into a wound package 12, 112 about the stationary generally vertical axis 38, 138.

The winder 40, 140 comprises a rotatable package collector or collet 42, 142 having a generally cylindrical surface 44, 144 about which the bundle 32, 132 is wound to form a wound package 12, 112 about the stationary generally vertical axis 38, 138. The wound package 112 can optionally be wound upon a tubular support 145 which is removably telescoped onto the collet 142, as shown in phantom in FIG. 4.

Referring to FIGS. 2 and 3, preferably, the collet 42 is a collapsible mandrel having a first, expanded position 352 for engaging and retaining the wound package upon the collet 42 and a second, collapsed position 354 for releasing the wound package from the mandrel. The collet 42 is expanded by a biasing spring (not shown) and collapsed by injecting compressed air into the collet 42 through a hollow shaft. Other methods and apparatus for expanding and collapsing the collet are understood by those skilled in the art and further discussion thereof is not believed to be necessary in view of the present disclosure.

As shown in FIGS. 2 and 3, the collet 42 has a first diameter 62 when in the first position and a second diameter 64 which is less than the first diameter 62 when in the second position. Preferably, the first diameter 62 is about 5 to about 10 centimeters, and more preferably about 7.5 centimeters. The second diameter 64 can be about 5.5 to about 10.5 centimeters, and preferably about 8 centimeters. The first diameter 62 and second diameter 64 can vary, based upon such factors as the type of winder 40 and the desired inner diameter of the wound package 12.

Alternatively, the package collector can include a retainer such as a moveable flange 162, shown in FIG. 4, which retains the wound package 112 upon the collet 142 when in a first position and releases the package 112 from the collet 142 when in a second position (shown in phantom as **162*a*). One skilled in the art would understand that any type of device which retains the package 12, 112 on the collet 42, 142 during winding and permits the package 12, 112** to be released after winding would be useful as a retainer in the present invention.

Referring now to FIGS. 1–4, the winder 40, 140 can be any winder capable of winding a package 12, 112 about a stationary generally vertical axis 38, 138. The winder 40, 140 includes an apparatus 46, 146 for rotating the package collector or collet 42, 142 about the stationary generally vertical axis 38, 138. The generally vertical axis 38, 138, which is both the longitudinal axis of the wound package 12, 112 and the central axis of rotation of the collet 42, 142, can be oriented at an angle 48, 148 of about 80° to about 100° and preferably about 85° to about 95°. More preferably, the angle 48, 148 is 90° with respect to the supporting surface 50, 150 for the system 10, 110, which is preferably the earth or ground, such that the axis 38, 138 is generally vertical to the supporting surface 50, 150.

As used herein, "stationary" means that the angle 48, 148 between the axis 38, 138 and the supporting surface 50, 150 essentially does not increase or decrease during winding and preferably remains constant during winding.

As shown in FIGS. 1–4, the apparatus 46, 146 includes a motor 56, 156, such as a variable speed motor, for rotating the collet 42, 142 about the vertical axis 38, 138. As the diameter of the wound package 12, 112 increases, the linear bundle speed can be measured by the speed of the bailer roll 66 using a tachometer (not shown) which signals the variable speed motor 56, 156 to adjust the motor speed to maintain essentially constant linear speed of the bundle 32, 132 during winding.

As best shown in FIG. 3, preferably the winder 40, 140 comprises a collet support 52, 152 which pivots away from the winder traverse 54, 154 as the diameter of the wound package 12, 112 increases during winding. Preferably, the winder 40, 140 includes a pressure device or bail roller 66, 158, best shown in FIG. 2, which is positioned proximate or abuts a portion 68 (not shown for purposes of clarity in FIG. 4) of the periphery 70 of the package 12 during winding. The collet support 52, 152 biases the portion 68 of the package 12, 112 against the bail roller 66,158 to provide pressure against the portion 68 to maintain the generally cylindrical shape of the package 12, 112. A pulley 300 having an adjustable weight, for example of 0 to about 50 kilograms, and preferably about 1 to about 10 kilograms, can be used to provide the biasing force.

As best shown in FIG. 2, the traverse 54, 154 displaces the bundle 32, 132 along an axis 55, 155 which is generally parallel to the generally vertical axis 38, 138. The traverse 54, 154 comprises a guide eye 58 (not shown for purposes of clarity in FIG. 4) for orienting the bundle 32, 132 during movement of the traverse 54, 154 back and forth across the wound package 12, 112 during winding. Preferably, the guide eye 58 includes an aperture 60, best shown in FIG. 2, for receiving and guiding the bundle 32, 132 therethrough. The aperture 60 can have any shape desired, although the aperture 60 is preferably generally circular. The diameter of the aperture 60 is preferably about 2 to about 6 millimeters, and more preferably about 2 to about 5 millimeters. The diameter and shape of the aperture 60 can vary based upon such factors as the diameter of the bundle 32, 132, the type of fibers 14, 114 and the coating upon the fibers.

The preferred winder 40, 140 is a Leesona Model 959 winder which is commercially available from Leesona Division of John Brown Textile Machinery of Burlington, N.C., which has been modified as shown in FIGS. 1–4 such that the collet 42, 142 rotates about the stationary generally vertical axis 38, 138. Conventionally, such a winder has been used with the collet in a horizontal position such that the collet rotates about a horizontal axis with respect to the supporting surface to form a wound package having a horizontally disposed longitudinal axis. The Leesona Model 959 winder of the preferred embodiment has been modified by positioning the winder 40, 140 such that the rotational axis 38, 138 of the collet 42, 142 is generally vertical with respect to the supporting surface 50, 150 rather than horizontal.

Another example of a winder useful in the present invention is a Dietze & Schell Model DS-51 winder which is commercially available from Dietze & Schell Maschinenfabrik Gmbh of Coburg, Germany, which has been modified such that the collet rotates about a stationary generally vertical axis.

Other useful winders are believed to include those for winding conventional forming or roving packages, such as are discussed in K. Loewenstein, *The Manufacturing Technology of Continuous Glass Fibers* (2d Ed. 1983) at pages 317–323, which can be modified to reorient the rotational axis of the winder to be generally vertical with respect to the supporting surface rather than horizontal.

As shown in FIGS. 1–4, the system 10, 110 also comprises a mechanical transport. The mechanical transport receives the wound package 12, 112 released from the package collector and transports the wound package 12, 112 from a first position to a second position horizontally spaced apart from the first position.

As shown in FIGS. 1–4, preferably the mechanical transport is a conveyor 72, 200. The conveyor 72, 200 comprises a motor 74, 202. Preferably, the motor is a Type GFG00-125/DK74-178 motor which is commercially available from Eberhard Bauer of Esslingen, Germany, capable of producing 1330 revolutions per minute (rpm) from the motor and 28.5 rpm from the outlet shaft of the gearbox. One skilled in the art would understand that any suitable motor capable of providing power to move the wound package 12, 112 from a first position to a second position would be useful in the present invention.

The motor 74, 202 is connected to a drive or gearbox. The gearbox has a shaft 76, 204 which includes a wheel 78, 206 having teeth which mesh with corresponding teeth of a first portion 82, 210 of a belt 84, 212. The motor 74, 202 rotates the shaft and wheel 78, 206 which in turn rotates the belt 84, 212.

The belt 84, 212 has a second portion 86, 214 spaced apart from the first portion 82, 210 which engages a first portion 88, 216 of a shaft 90, 218 for translating the rotational movement of the belt 84, 212 to the shaft 90, 218. The shaft 90, 218 includes a toothed wheel which engages a first, correspondingly toothed portion 92, 220 of a conveyor belt 94, 222 for translating the rotational movement of the shaft 90, 218 to the conveyor belt 94, 222. One skilled in the art would understand that the belts 84, 212, 94, 222 can alternatively be frictionally engaged with the wheels of the shafts.

The conveyor belt 94, 222 is preferably a continuous loop in which the first portion 92, 200 engages the shaft 90, 218 and having a second, toothed portion 96, 224 which engages a toothed wheel of a shaft 98, 226. When shaft 90, 218 is rotated, the first portion 92, 200 of the conveyor belt 94, 222 moves in the general direction indicated by arrow 100, 228.

The conveyor belt 94, 222 is preferably formed from a flexible material such as a urethane material. The preferred belt is an 007 synchroflex T10/50 urethane belt which is commercially available from Bergmann of Germany. The surface 95, 223 of the conveyor belt is preferably generally smooth, although the surface 95, 223 can have protrusions, raised or indented portions to provide security for the wound package 12, 112 when the conveyor belt 94, 222 is in motion.

Preferably, the conveyor belt(s) 94, 222 is sufficiently wide and thick to stably accommodate the wound package 12, 112 on the belt(s) and to prevent the wound package 12, 112 from being damaged during transport. As shown in FIG. 3, the conveyor belt 94, 222 is preferably supported by a smooth plate 102. The width of the conveyor belt 94, 222 can be about 4 to about 50 centimeters and is preferably about 4 to about 6 centimeters wide for each of two belts when used. The thickness of the conveyor belt 94, 222 can be about 1 to about 5 millimeters and can vary based upon such factors as the dimensions and weight of the wound package 12, 112. The conveyor belt 94, 222 is preferably moved at a speed of about 0.5 to about 2 meters/minute, and preferably about 1 meter/minute.

As presently preferred, two generally parallel conveyor belts 94, 222, each belt being about 4 centimeters wide and about 5 millimeters thick, are used in the present invention. One skilled in the art would understand that one or a plurality of conveyor belts 94, 222 can be used in the present system 10, 110.

The conveyor belt 94, 222 has a portion 102, 230 for receiving the wound package 12, 112 released from the package collector. The released wound package 104, 232 is shown in phantom in the first position on the conveyor belt 94, 222 in FIGS. 1, 2 and 4. When shaft 90, 218 is rotated, the portion 102, 230 of the conveyor belt 94, 222 moves in the general direction indicated by arrow 100, 228 to move the released package 104, 232 to the second position which is horizontally spaced apart from the first position. The movement of the conveyor is stopped when a detector indicates that the package 12, 112 has reached the desired position. In the second position, the removable wound package 106, 234 can be easily removed by a variety of means, such as by an operator (not shown) or by mechanical means such as a lift (not shown).

To inhibit damage during release of the wound package 12, 112 from the collet 42, 142 and transfer to the first position on the conveyor belt 94, 222, the mechanical transport preferably includes a package carrier 108, 236. As best shown in FIG. 3, the package carrier 108, 236 includes a moveable platform 116, 238. Referring now to FIG. 2, the platform 116, 238 has a first, extended position 118 for receiving the wound package 12, 112 upon release from the collet 42, 142 and a second, retracted position 120, 240 in which the released package 104, 232 is deposited upon the conveyor belt 94, 222. The extended position is not shown for purposes of clarity in FIG. 4, but for the alternative embodiment the extended position is similar in configuration and operation to that disclosed for the preferred embodiment above.

The platform 116, 238 includes an indentation 122, 242 or aperture which accommodates the bottom 124, 244 of the collet 42, 142 to permit the bottom 126, 246 of the released package 104, 232 to be positioned directly upon the platform 116, 238 and inhibit damage to the released package 104, 232.

The platform 116, 238 can be constructed from any generally rigid material, such as steel or aluminum, for example, and can have any dimensions capable of supporting the released package 104, 232 without interfering with the operation of the carrier 108, 236. In the presently preferred embodiment, the platform 116, 238 has a width 128, 248 of about 8 centimeters, which is receivably accommodated between the conveyor belts 72, 222 without inhibiting operation of the conveyor belts 72, 222. In the retracted, second position 120, 240, the platform 116, 238 is positioned below the conveyor belts 72, 222 such that the released package 104, 232 is deposited upon the conveyor belts 72, 222.

The platform 116, 238 is supported by a rotatable spindle 129 (not shown in FIG. 4 for purposes of clarity). The spindle 129 is moved between the first, extended position 118 and the second, retracted position 120, 240 by a motor 131, 250. A non-limiting example of a suitable motor is a Type G01-10/DK64-163L motor which is commercially available from Eberhard Bauer, capable of producing 1330 (rpm) from the motor and 550 rpm from the outlet shaft of the gearbox. One skilled in the art would understand that any motor capable of generating sufficient torque to extend and retract the spindle 129 would be useful in the present invention.

The process according to the present invention for winding a bundle of fibers at a first position and mechanically transporting the wound package to a second position horizontally spaced apart from the first position will now be described generally.

With reference to FIGS. 1–4, the method generally comprises the initial step of supplying a plurality of fibers 14, 114. As shown in FIGS. 1–3, in the preferred embodiment the fibers 14 are supplied to the system 10 from a plurality of fiber supply packages 16. Tensioning devices 26 can be used to apply substantially equal tension to each of the fibers 14 to inhibit catenary or sag of the individual fibers 14 in the bundle 32, 132.

In the alternative embodiment, the fibers 114 are supplied to the system 110 by drawing the fibers 114 from a fiber forming apparatus 164. A sizing composition can be applied to the fibers 14 by an applicator device. The fibers 114 can be gathered into groupings or strands 172 by an alignment device, as discussed above.

The plurality of fibers 14 is gathered to form a bundle 32, 132. In the preferred embodiment, the fibers 14 are gathered by a guide 30. In the alternative embodiment, the fibers 114 are gathered and reoriented from traveling in a vertical direction to a horizontal direction by a pulley 176 and gathered by a guide 130. Tension is applied to the bundle by a feed roll and mating nip roll.

The process further comprises winding the fiber bundle 32, 132 upon a rotatable package collector of a winder to form a wound package 12, 112.

After winding has ceased, the carrier 108, 236 receives the wound package 12, 112 after release from the collet 42, 142 and moves the released package 104, 232 generally vertically downward to deposit the released package 104, 232 in a first position on a mechanical transport, preferably a conveyor 72, 200. The released package 104, 232 is mechanically transported from the first position to a second position horizontally spaced apart from the first position. In the second position, the package can be removed from the system 10, 110 by an operator or transport device.

The process of the present invention is not limited to use in making roving or forming packages, but can also be useful in any process in which a plurality of fibers is gathered into a bundle and wound into a package.

The operation of the system 10, 110 to perform the process according to the present invention will now be described. However, other apparatus than that shown and described herein could be used to perform the method of the present invention, if desired.

In the initial sequence of operation of the preferred embodiment, the supply packages 16 are positioned in the creel 24 and each fiber 14 is threaded through its respective tensioning device 26.

In the alternative embodiment, fibers are drawn from a fiber forming apparatus 164 and preferably coated with a sizing composition and gathered into a plurality of strands 172 by an alignment device. Also, the strands 172 are reoriented from vertical to horizontal by passage over a pulley 176.

In each embodiment, the fibers 14, 114 are gathered and threaded through the guide 30, 130 to form the bundle 32, 132. The bundle 32, 132 is threaded between the feed roll and nip roll. The bundle 32, 132 is threaded through the guide eye 58 of the bail roller 66 and wound about the collet 42, 142 and winding is commenced. Pressure is applied to the bundle by the nip roll. When the wound package 12, 112 is completed, the winder 40, 140 or operator ceases the winding operation.

The process and system 10, 110 of the present invention will now be illustrated by the following specific, non-limiting examples.

EXAMPLE 1

Three groups of sample supply packages were prepared by winding 2400 tex E-glass fibers coated with three different sizing compositions, respectively. The fibers used are commercially available as products No. 1084, No. 6428 and No. 5574, respectively, of PPG Industries, Inc. of Pittsburgh, Pa.

Roving packages were prepared from each of the three groups of supply packages using the preferred system of the present invention described above using a Leesona 959 winder modified as discussed above. For the roving packages prepared according to the present invention, 15 grams of tension was provided to each strand by a disk-type weight placed on the strand as a tensioning device. The linear speed of the bundle was about 320 meters/min. The weight of each roving package was about 35 kilograms.

From the foregoing description, it can be seen that the present invention provides a simple, economical system and process for winding, manipulating and transporting wound packages to reduce labor and waste disposal costs and increase efficiency and productivity.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

Therefore, we claim:

1. A system for winding and mechanically transporting a wound package, the system comprising:

(a) a plurality of fibers;

(b) a guide for gathering the plurality of fibers to form a bundle;

(c) a winder comprising a rotatable package collector and an apparatus for rotating the package collector about a stationary generally vertical axis, the package collector receiving the bundle from the guide and forming the bundle into a wound package about the generally vertical axis, the package collector having a release for releasing the wound package so as to deposit the wound package on a mechanical transport; and (d) a mechanical transport for receiving the wound package from the package collector and transporting the wound package from a first position to a second position horizontally spaced apart from the first position.

2. The system according to claim 1, wherein each fiber is an individual filament.

3. The system according to claim 1, wherein each fiber is a strand, each of the strands comprising a plurality of individual filaments.

4. The system according to claim 1, wherein the fibers are selected from the group consisting of natural fibers and man-made fibers.

5. The system according to claim 4, wherein the fibers are glass fibers.

6. The system according to claim 1, wherein the guide is selected from the group consisting of a guide eye, a gathering shoe and a pulley.

7. The system according to claim 6, wherein the guide is a pulley which comprises a rotatable pulley roll having a groove for gathering the plurality of fibers to form the bundle.

8. The system according to claim 1, wherein the bundle is wound about a surface of the package collector.

9. The system according to claim 1, wherein at least a portion of a surface of the package collector is encased by a removable tubular support, the bundle being wound about a surface of the tubular support.

10. The system according to claim 1, wherein the package collector comprises a collapsible mandrel having a first, expanded position for engaging and retaining the wound package upon the mandrel and a second, collapsed position for releasing the wound package from the mandrel.

11. The system according to claim 1, wherein the package collector further comprises a retainer for retaining the wound package on the package collector.

12. The system according to claim 1, wherein the package collector further comprises a traverse for displacing the bundle along an axis generally parallel to the generally vertical axis.

13. The system according to claim 1, wherein the package collector further comprises a pressure device for applying pressure to a portion of a periphery of the wound package.

14. The system according to claim 13, wherein the pressure device comprises a bailer roll having a surface, a portion of the surface of the bailer roll being positioned proximate the portion of the periphery of the wound package during winding for applying pressure to the portion of the periphery of the wound package.

15. The system according to claim 1, wherein the mechanical transport comprises a conveyor.

16. The system according to claim 15, wherein the conveyor comprises a motor, a drive connected to the motor and a conveyor belt connected to the drive, the conveyor belt having a portion for receiving the wound package released from the package collector, the portion of the conveyor belt being moveable between a first position and a second position horizontally spaced apart from the first position, such that (a) when the portion of the conveyor belt is in the first position, the portion receives the wound package at the first position and (b) when the portion of the conveyor belt is in the second position, the wound package is horizontally spaced apart from the first position.

17. The system according to claim 1, wherein the system further comprises a fiber forming apparatus for forming the fibers.

18. The system according to claim 1, wherein the system further comprises a supply for supplying the fibers including (a) a plurality of fiber supply packages, each supply package permitting withdrawal of a fiber wound thereon and (b) a frame adapted to support the plurality of fiber supply packages.

19. The system according to claim 18, wherein the system further comprises a plurality of tensioning devices, each tensioning device receiving each fiber withdrawn from each supply package and applying a tension to the fiber, wherein the tension applied to each of the fiber strands is substantially equal.

20. A process for winding a bundle of fibers to form a wound package at a first position and mechanically transporting the wound package to a second position horizontally spaced apart from the first position, the process comprising:

(a) supplying a plurality of fibers;

(b) gathering the plurality of fibers to form a bundle;

(c) winding the bundle upon a rotatable package collector of a winder about a stationary generally vertical axis to form a wound package;

(d) releasing the wound package from the package collector to a first position; and (e) mechanically transporting the wound package released from the package collector from the first position to a second position horizontally spaced apart from the first position.

* * * * *